US010845051B2

(12) United States Patent
Wilson et al.

(10) Patent No.: US 10,845,051 B2
(45) **Date of Patent: *Nov. 24, 2020**

(54) PORTABLE FLARE

(71) Applicant: Cherokee Flare Pipe, LLC, Cherokee, OK (US)

(72) Inventors: Robert Leroy Wilson, Cherokee, OK (US); Marcel John Gosselin, Burlington, OK (US)

(73) Assignee: Cherokee Flare Pipe, LLC, Cherokee, OK (US)

( * ) Notice: Subject to any disclaimer, the term of this patent is extended or adjusted under 35 U.S.C. 154(b) by 123 days.

This patent is subject to a terminal disclaimer.

(21) Appl. No.: 16/351,367

(22) Filed: Mar. 12, 2019

(65) Prior Publication Data

US 2019/0203934 A1 Jul. 4, 2019

Related U.S. Application Data

(63) Continuation-in-part of application No. 14/535,260, filed on Nov. 6, 2014, now Pat. No. 10,228,130.

(60) Provisional application No. 61/982,835, filed on Apr. 22, 2014, provisional application No. 61/900,977, filed on Nov. 6, 2013.

(51) Int. Cl.

| | |
|---|---|
| ***F23G 7/08*** | (2006.01) |
| ***F23Q 9/08*** | (2006.01) |
| ***F23G 5/40*** | (2006.01) |
| ***F23G 5/50*** | (2006.01) |

(52) U.S. Cl.

CPC ..... *F23G 7/08* (2013.01); *F23G 5/40* (2013.01); *F23G 5/50* (2013.01); *F23Q 9/08* (2013.01); *F23G 2207/20* (2013.01); *F23G 2209/14* (2013.01)

(58) Field of Classification Search

CPC ..... F23G 7/08; F23G 5/40; F23G 5/50

USPC ..... 431/202; 166/368, 336, 75.11

See application file for complete search history.

(56) References Cited

U.S. PATENT DOCUMENTS

| | | | | |
|---|---|---|---|---|
| 4,265,611 A * | 5/1981 | Reed | F23G 7/08 | 431/202 |
| 4,907,964 A * | 3/1990 | Howarth | F23G 7/08 | 431/202 |
| 5,957,681 A * | 9/1999 | Hansen | F23G 7/085 | 431/202 |
| 6,431,855 B1 * | 8/2002 | Pedersen | E21B 41/0071 | 431/202 |
| 8,390,981 B1 * | 3/2013 | Treadaway | F23Q 21/00 | 361/253 |
| 10,228,130 B2 * | 3/2019 | Wilson | F23G 7/085 | |
| 2011/0132592 A1 * | 6/2011 | Apple | E21B 43/006 | 166/53 |

(Continued)

*Primary Examiner* — Nina Bhat

(74) *Attorney, Agent, or Firm* — Martin S. High, P.C.; Martin S. High

(57) ABSTRACT

The Portable Flare is comprised of a pilot assembly, an air tube assembly, a burn gas tube assembly, a flame tube, a control system, a transport assembly, and a hydraulic lift. The pilot assembly is comprised of pilot gas supplied from the well site, a pilot gas supply line, a low-pressure regulator, a pressure measurement tap, a valve, a burner, an ignitor, and a pilot thermocouple. The temperature of the flame is controlled by monitoring the main burn thermocouple and adjusting the air flow with the blower that forces air up the air tube to mix with the burn gas.

9 Claims, 5 Drawing Sheets

(56) References Cited

U.S. PATENT DOCUMENTS

2017/0361363 A1* 12/2017 Daniel ..... B08B 9/0325
2019/0366400 A1* 12/2019 Chambers ..... B09B 1/006

* cited by examiner

PORTABLE FLARE

STATEMENT REGARDING FEDERALLY SPONSORED RESEARCH OR DEVELOPMENT

Not applicable

FIELD OF THE EMBODIMENTS

The field of the embodiments is oil field equipment, specifically oil field gas flares.

BACKGROUND OF THE EMBODIMENTS

The background of the embodiments involves the design of a portable flare to safely dispose of gas and oil well site gases.

SUMMARY OF THE EMBODIMENTS

This is a transportable forced air elevated flare with a better than 98% burn efficiency. This is all built on a trailer to be able to move quickly to different locations. The unit is self-contained and can be quickly setup and put in operation without the use of cranes or other heavy equipment. The unit is also able to carry steel pipe and different types of hoses to allow this unit to tie to tank batteries or well heads.

DETAILED DESCRIPTION OF THE PREFERRED EMBODIMENTS

Figure 1:
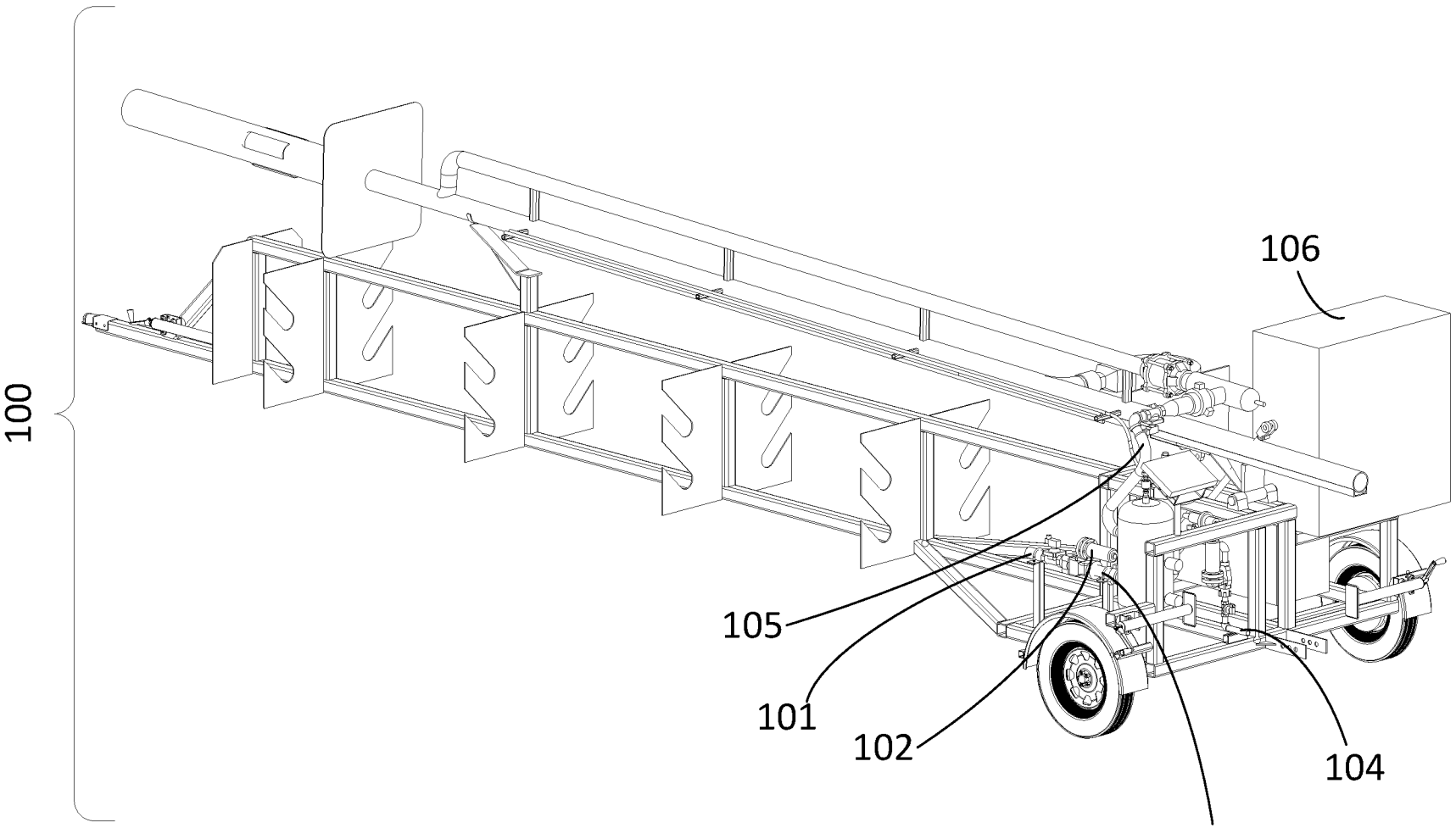
FIG. 1 is a side elevation view of the Portable Flare.
Figure 2:
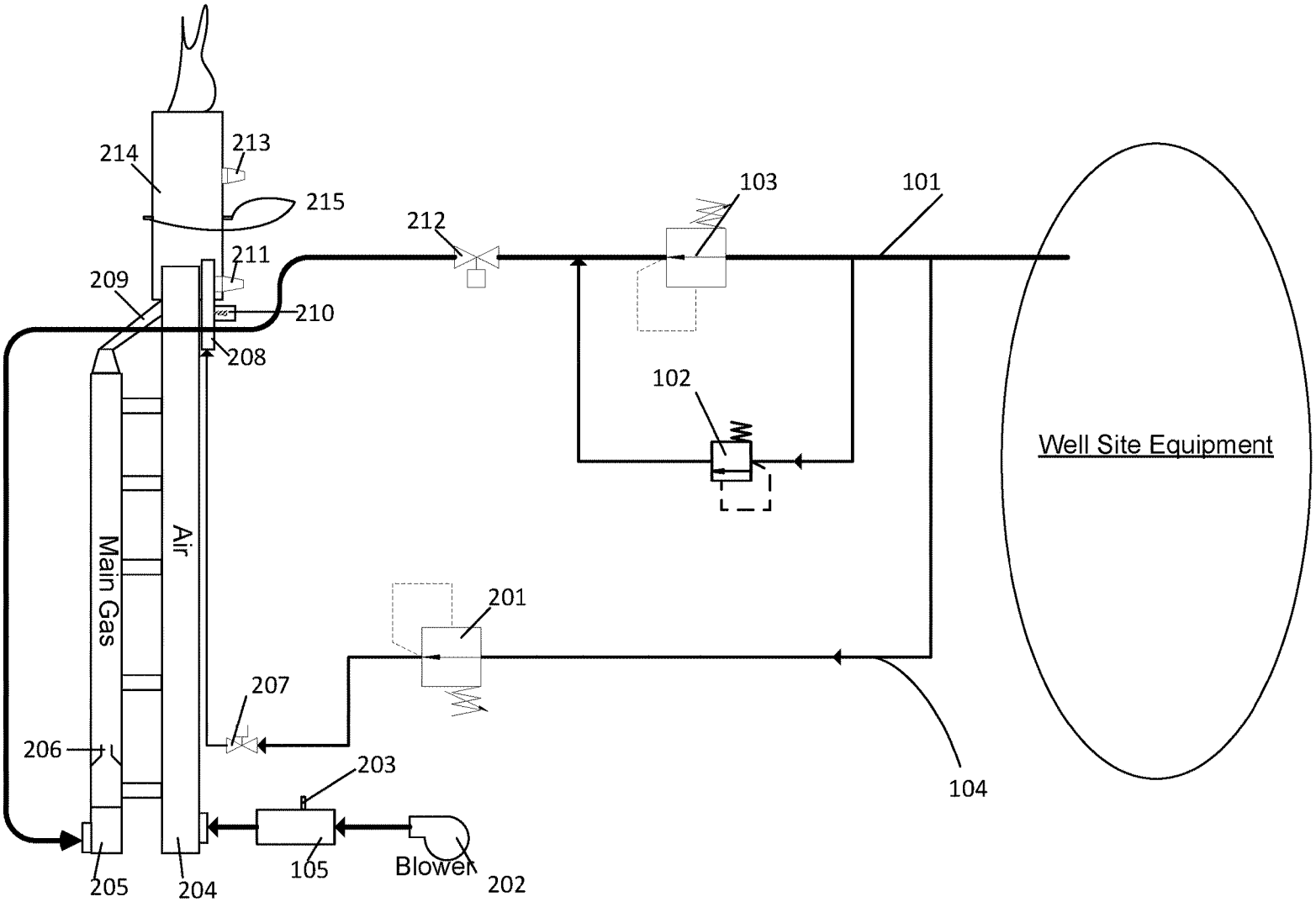
FIG. 2 is a fluid flow schematic of an embodiment of the Portable Flare.
Figure 3:
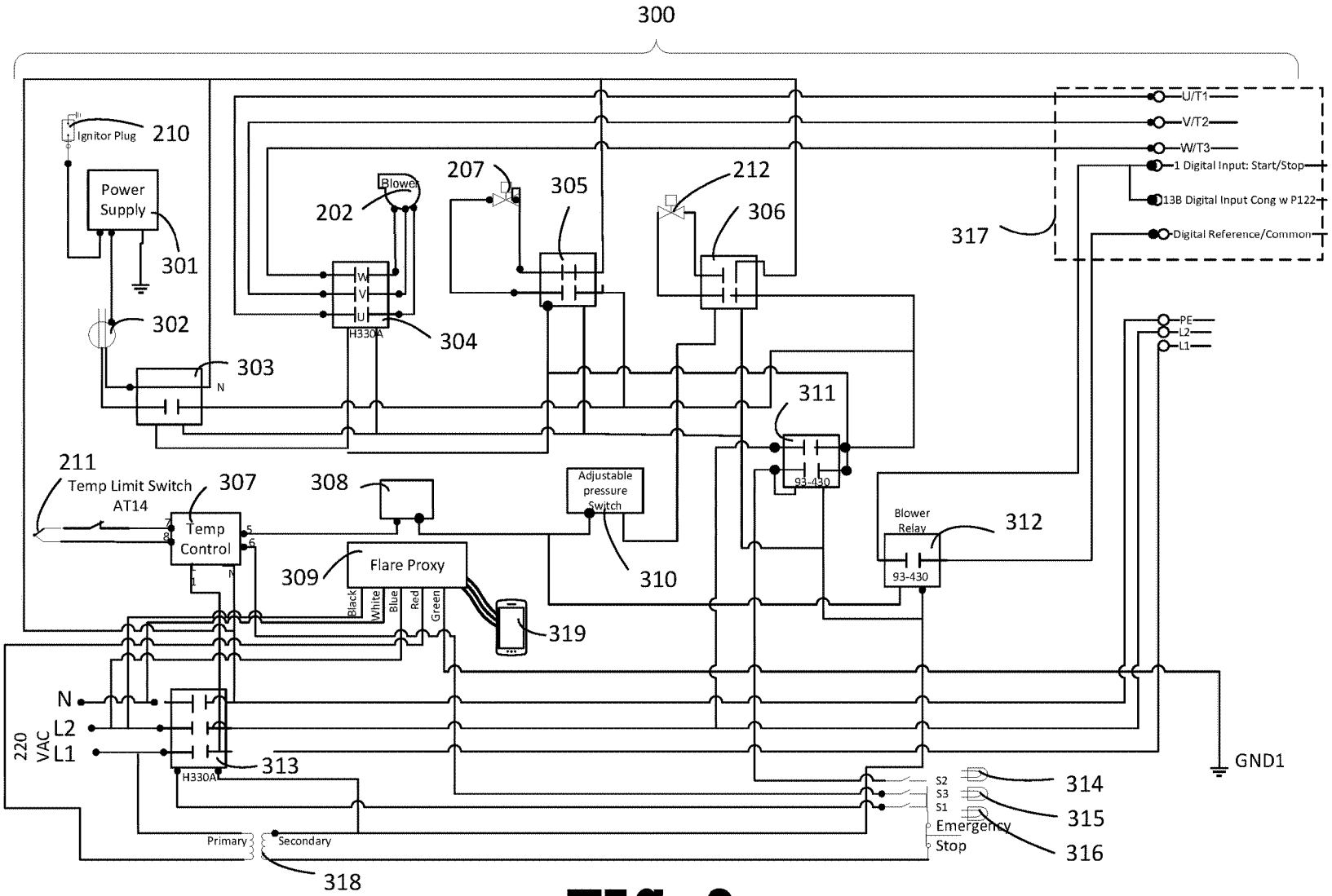
FIG. 3 is an electrical schematic of an embodiment of the control system for the Portable Flare.
Figure 4A:
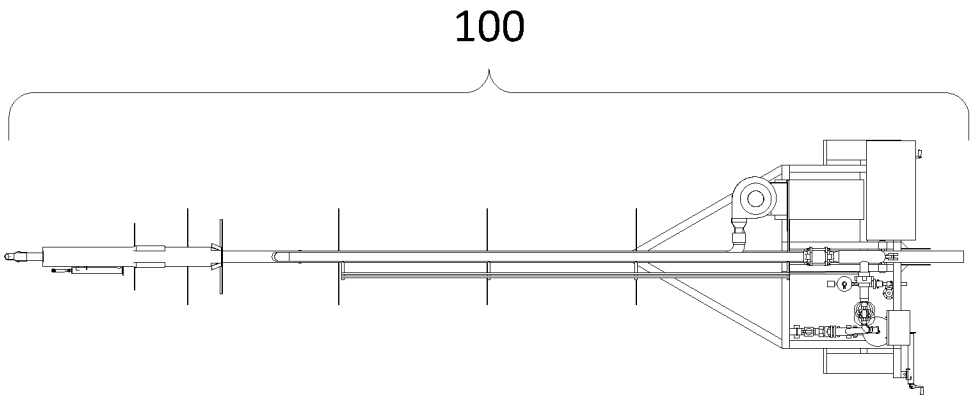
FIG. 4A is a top view of an embodiment of the Portable Flare.
Figure 4C:
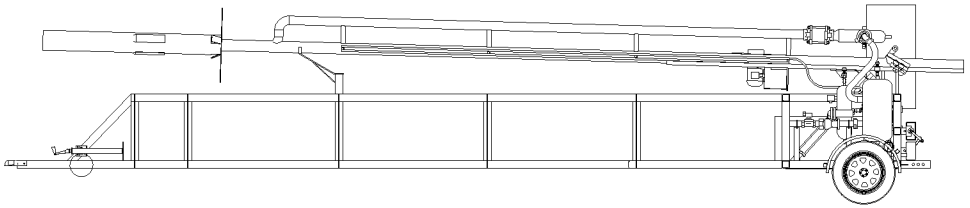
FIG. 4C is a side view of an embodiment of the Portable Flare.
Figure 4D:
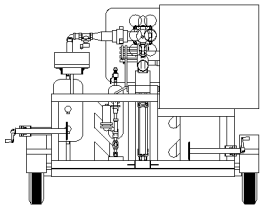
FIG. 4D is a rear view of an embodiment of the Portable Flare.
Figure 4B:
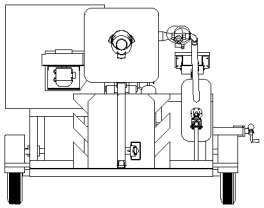
FIG. 4B is a front view of an embodiment of the Portable Flare.
Figure 5B:
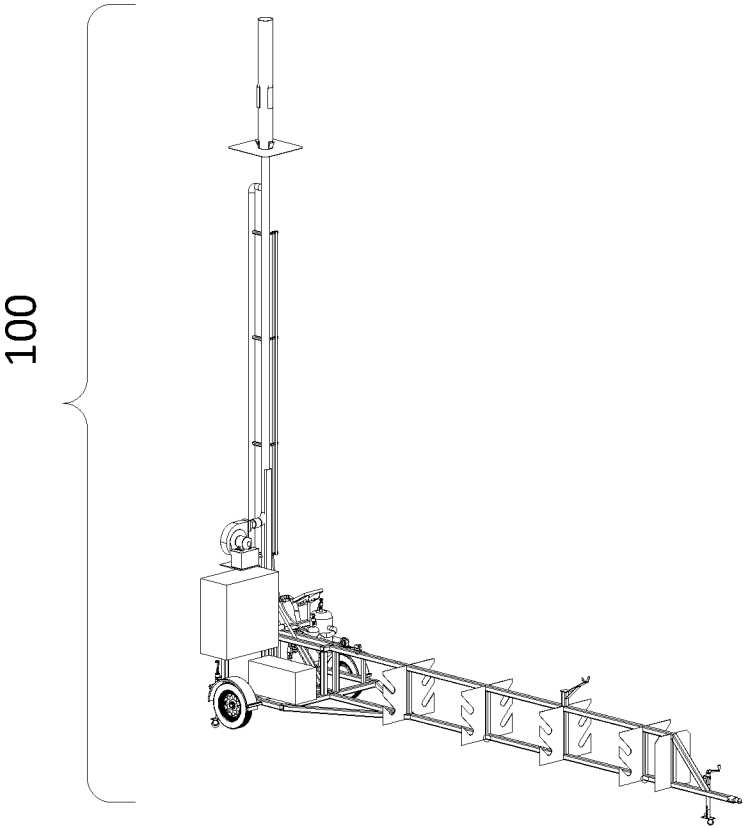
FIG. 5B is a perspective view of an embodiment of the Portable Flare in the operational configuration.
Figure 5A:
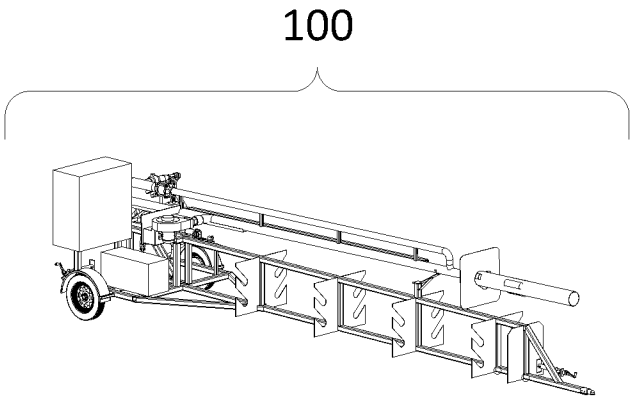
FIG. 5A is a perspective view of an embodiment of the Portable Flare in the transportable configuration.

A preferred embodiment of the Portable Flare 100 is comprised of a pilot assembly, an air tube assembly, a burn gas tube assembly, a flame tube, a control system 300, a transport assembly, and a hydraulic lift.

The pilot assembly is comprised of pilot gas supplied from the well site, a pilot gas supply line 104, a low-pressure regulator 201, a pressure measurement tap 203, a valve 207, a burner 208, an ignitor 210, and a pilot thermocouple 211. The pilot gas comes from the well site through a 1-inch pipe. The flare pipe control system operates a valve 207 to turn on and off the pilot gas to the flare. The pilot gas then enters a ½ inch pipe running up the side of the flare pipe and then flows to the burner 208. The pilot gas is ignited by a continuously sparking ignitor 210. The pilot flame is then directed across the main outlet of gas and air to ignite the main gas flow.

The air tube assembly is comprised of a blower 202, a vibration isolation hose 105, and a 3-inch air tube 204. The air for the assist air flow is pulled from the environment and blown into the air tube using the blower 202. The temperature of the flame is controlled by monitoring the main burn thermocouple 213 and adjusting the air flow with the blower 202 that forces air up the air tube 204 to mix with the burn gas.

The burn gas assembly is comprised of the main gas line 101, high pressure regulator 103, a high-pressure relief valve 102, an electrically controlled valve 212, a main gas pipe 205, a flame arrestor 206, a main burn gas reduction 209, a burn tube 214, and a main burn thermocouple 213. The burn gas comes from the well site storage tanks through 2-inch line connected to the flare pipe. The flare pipe controls a valve 212 to turn on and off the burn gas to the flare. The main burn gas pipe is connected to the main burn gas reduction 209, which is a 2-inch pipe. The main burn gas then merges with the air tube 204 and mixes the burn gas and air for a clean burn. A clean burn is a burn with a high enough temperature to thermally destroy any $H_2S$ and other toxic and carcinogenic compounds. This mixture of air and burn gas is then ignited by the ignitor 210 and burned off inside the burn tube 214. The burn tube allows the gas and air to mix sufficiently for a clean burn. In one embodiment, the burn tube 214 is 6 ft. long and 8 inches in diameter and has air inlets 215 to create a venturi effect to pull in additional assist air.

The transport assembly is comprised of a custom-made Department of Transportation (DOT) approved trailer and hydraulic lift. The transport assembly is comprised of electric brakes, LED lights, red and white reflective tape, brake controls, safety chains, and a 2-inch ball hitch.

The control system 300 is comprised of relays, timers, data collection, pressure switch 310, GPS tracking, algorithm circuit board, time delay relays, a transformer 318, induced blower motor, 1-5 Hp motor, frequency drivers, gas valve, igniter, flame sensor. The control system 300 supplies power via the ignitor power source 301 to the spark ignitor 210. The igniter power source 301 receives power from a 110 V receptacle 302. The 110 V Receptacle Relay 303 switches power to the 110 V receptacle 302. The control system 300 is housed within the control system chassis 106.

In one embodiment of the Portable Flare 100 the control system 300 is comprised of a computer controlled open/close electric valve 207; an ignitor power source 301 powered by a 110 v ignitor receptacle 302; a 110 v receptacle relay 303 that controls the 110 v receptacle 302; a blower motor relay 304; a pilot gas relay 305; a main burner gas relay 306; a pilot temperature control 307; a time delay 308; a flare proxy 309 that interfaces to cellular telephone network and a remote cellular telephone 319 that in turn controls (on/off) functions, GPS tracking of the Portable Flare 100, and collects and presents data to the remote cellular telephone; pressure switch 310; an ignitor relay 311 which proves a first sequence of operations; a blower relay 312 which provides power source to a frequency inverter 317; a main power relay 313; a pilot gas activation indicator light 314; a flare proxy indicator light 315; and a main power source indicator 316.

The temperature of the main flame is monitored via the main burn thermocouple 213. The flow rate of the air is controlled via the induced blower motor 202. The temperature of the main burn thermocouple is maintained at a high enough temperature to thermally destroy any $H_2S$ and other toxic and carcinogenic compounds.

A pilot thermocouple 211 monitors the temperature of the pilot flame. If the pilot flame is not maintained at or above 600° F., the pilot temperature control 307 prevents the main gas control valve 212 from opening. In this manner, the control system 300 prevents the Portable Flare 100 from operating until the proper pilot temperature is established.

What is claimed is:

1. A portable flare comprised of a pilot assembly, an air tube assembly, a burn gas tube assembly, a flare pipe control system, a control system, and a transport assembly wherein the pilot assembly is comprised of a pilot gas supply line, a low-pressure regulator, a pressure measurement tap, a valve, an ignitor, a pilot thermocouple, a valve to turn on and off pilot gas to the flare, a burner, and a continuously sparking ignitor.

2. The portable flare described in claim 1 wherein the air tube assembly is comprised of a blower, a vibration isolation hose, a 3-inch air tube, a blower, and a main burn thermocouple.

3. The portable flare described in claim 1 comprised of a flare proxy that interfaces to cellular telephone networks and a remote cellular telephone that in turn controls (on/off) functions, tracks the portable flare via GPS, and collects and presents data to the remote cellular telephone.

4. The portable flare described in claim 2 wherein a flame temperature is controlled by monitoring the main burn thermocouple and adjusting air flow with the blower that forces air up the 3-inch air tube to mix with burn gas to be destroyed.

5. The portable flare described in claim 1 wherein the burn gas assembly is comprised of the main gas line, high pressure regulator, a high-pressure relief valve, an electrically controlled valve, a main gas pipe, a flame arrestor, a main burn gas reduction, a burn tube, and a main burn thermocouple.

6. The portable flare described in claim 5 wherein the flame temperature is maintained for a clean burn by adjusting the burn gas to be destroyed and air mix for a clean burn.

7. The portable flare described in claim 6 wherein the burn tube is 6 ft. long and 8 inches in diameter and forms air inlets to create a venturi effect to pull in additional air.

8. The portable flare described in claim 1 wherein the transport assembly is comprised of a Department of Transportation (DOT) approved trailer and hydraulic lift, electric brakes, LED lights, red and white reflective tape, brake controls, safety chains, and a 2-inch ball hitch.

9. The portable flare described in claim 1 wherein the control system is comprised of a computer controlled open/close electric valve; an ignitor power source powered by a 110 V ignitor receptacle; a 110 V receptacle relay that controls the 110 V ignitor receptacle; a blower motor relay which controls a blower motor; a pilot gas relay; a main burner gas relay; a pilot temperature control; a time delay; a flare proxy that interfaces to cellular telephone network and a remote cellular telephone that in turn controls (on/off) functions, tracks the portable flare via GPS, and collects and presents data to the remote cellular telephone; a pressure switch; an ignitor relay which proves a first sequence of operations; a blower relay which provides power source to a frequency inverter; a main power relay; a pilot gas activation indicator light; a flare proxy indicator light; and a main power source indicator.

* * * * *